US009293836B2

(12) United States Patent
Honzawa

(10) Patent No.: US 9,293,836 B2
(45) Date of Patent: Mar. 22, 2016

(54) ANTENNA APPARATUS

(71) Applicant: Kabushiki Kaisha Toshiba, Minato-ku (JP)

(72) Inventor: Akihiko Honzawa, Kawasaki (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 236 days.

(21) Appl. No.: 13/938,360

(22) Filed: Jul. 10, 2013

(65) Prior Publication Data

US 2014/0125542 A1 May 8, 2014

(30) Foreign Application Priority Data

Nov. 6, 2012 (JP) ..... 2012-244411

(51) Int. Cl.

| | |
|---|---|
| ***H01Q 1/52*** | (2006.01) |
| ***H01Q 15/14*** | (2006.01) |
| ***H01Q 19/13*** | (2006.01) |
| ***H01Q 13/02*** | (2006.01) |

(52) U.S. Cl.

CPC ..... *H01Q 19/13* (2013.01); *H01Q 1/528* (2013.01); *H01Q 13/0258* (2013.01); *H01Q 15/14* (2013.01)

(58) Field of Classification Search

CPC ..... H01Q 1/528; H01Q 15/14; H01Q 15/16; H01Q 19/021; H01Q 19/022; H01Q 19/023; H01Q 19/027; H01Q 19/12; H01Q 19/13

USPC ..... 343/775, 781 R, 840, 878, 912

See application file for complete search history.

(56) References Cited

U.S. PATENT DOCUMENTS

| | | | | |
|---|---|---|---|---|
| 2,706,781 | A * | 4/1955 | Goss, Jr. | 74/1 R |
| 3,599,219 | A * | 8/1971 | Holtum et al. | 343/840 |
| 5,182,569 | A * | 1/1993 | Bui-Hai | 343/781 CA |

(Continued)

FOREIGN PATENT DOCUMENTS

| | | |
|---|---|---|
| CN | 2408577 Y | 11/2000 |
| CN | 101809817 A | 8/2010 |
| JP | 1-135808 U | 9/1989 |

(Continued)

OTHER PUBLICATIONS

Office Action issued May 26, 2015 in Japanese Patent Application No. 2013-185971 (with English language translation).

(Continued)

*Primary Examiner* — Robert Karacsony
*Assistant Examiner* — Patrick Holecek
(74) *Attorney, Agent, or Firm* — Oblon, McClelland, Maier & Neustadt, L.L.P.

(57) ABSTRACT

According to one embodiment, an antenna apparatus includes a concave curved reflector, a radiator arranged in a focal position of the reflector to perform at least one of transmission of two linearly polarized waves toward a concave surface of the reflector and reception of the waves from the concave surface, the two linearly polarized waves being crossed orthogonally to each other, and a structural unit configured to support the radiator at the focal position. The unit includes a main body protruding from a rear surface of the reflector into a radiation space defined by the concave surface at a position on the concave surface, the position being apart from two linear polarization planes defined by the two linearly polarized waves.

8 Claims, 6 Drawing Sheets

(56) References Cited

U.S. PATENT DOCUMENTS

| | | | | |
|---|---|---|---|---|
| 8,314,745 | B2 * | 11/2012 | Omuro | 343/840 |
| 2009/0231224 | A1 | 9/2009 | Felstead et al. | |

FOREIGN PATENT DOCUMENTS

| | | | |
|---|---|---|---|
| JP | 2002-299940 | A | 10/2002 |
| JP | 2004-260836 | A | 9/2004 |
| JP | 2006-308510 | | 11/2006 |
| JP | 2008-178101 | | 7/2008 |

OTHER PUBLICATIONS

Combined Office Action and Search Report issued May 29, 2015 in Chinese Patent Application No. 201310316493.5 (with English language translation).

Office Action mailed Jan. 12, 2016 in Chinese Application No. 201310316493.5 (w/English translation).

* cited by examiner

ANTENNA APPARATUS

CROSS-REFERENCE TO RELATED APPLICATIONS

This application is based upon and claims the benefit of priority from Japanese Patent Application No. 2012-244411, filed Nov. 6, 2012, the entire contents of which are incorporated herein by reference.

FIELD

Embodiments described herein relate generally to an antenna apparatus.

BACKGROUND

An antenna apparatus including a reflector having a concave curved surface, typically a parabolic surface, and a radiator arranged at a focal position of the concave curved surface of the reflector is widely known. In the reflector of such an antenna apparatus, a structural member such as a waveguide and waveguide mounting member is normally not arranged in a radiation space between the radiator and the reflector from the viewpoint of performance improvement, because the structural member could become an obstacle to emission or reception of a radio wave. Particularly, in an antenna apparatus for dual polarized waves, a structural member (such as a waveguide and waveguide mounting member) that could become an obstacle is arranged outside the radiation space, because such a structural member is an important factor of performance degradation.

In a conventional antenna apparatus configured as described above, it is necessary to design the reflector so that its stiffness is increased and also to design the structural member so that its stiffness is increased, in order to arrange the structural member (such as a waveguide and waveguide mounting member) in the outside of the radiation space.

In a technical field of the antenna apparatus, like in other technical fields, it is always required to reduce various costs such as manufacturing costs, assembly costs, and maintenance costs relating thereto in comparison with the conventional ones.

DETAILED DESCRIPTION

Figure 1:
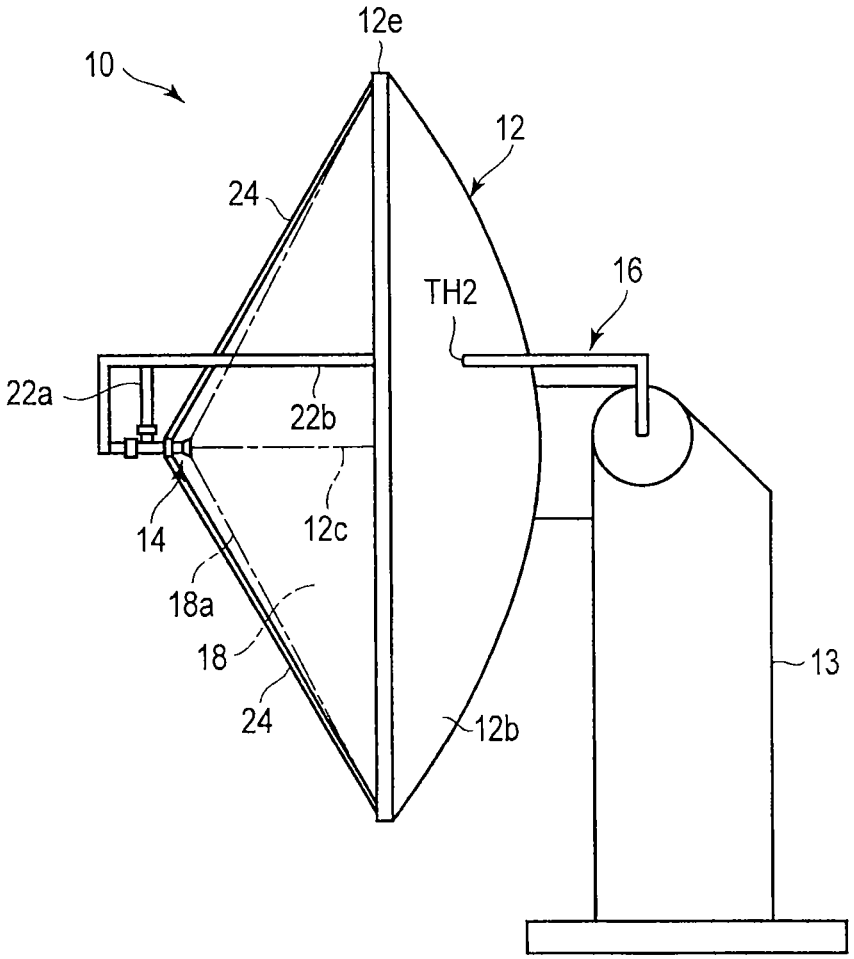
FIG. 1 is an exemplary side view schematically showing a whole of an antenna apparatus according to a first embodiment.

In general, according to each of several embodiments described in the followings, an antenna apparatus comprises: a reflector including a concave curved surface for reflecting a radio wave, a rear surface positioned on a back side of the concave curved surface, a radio axis of the radio wave reflected by the concave curved surface, and a focal position of the concave curve; a radiator arranged in the focal position of the concave curved surface of the reflector and configured to perform at least one of transmission of the radio wave of two linearly polarized waves toward the concave curved surface of the reflector and reception of the radio wave from the concave curved surface, the two linearly polarized waves being crossed orthogonally to each other; and a structural unit configured to support the radiator at the focal position, wherein a radiation space is defined between the concave curved surface of the reflector and the radiator, and two linear polarization planes are defined by two linearly polarized waves on the concave curved surface. And, in the antenna apparatus configured as described above, the structural unit includes a main body protruding from the rear surface of the reflector into the radiation space at a position on the concave curved surface of the reflector, the position being apart from the two linear polarization planes.

First Embodiment

A configuration of an antenna apparatus 10 according to a first embodiment will be described with reference to FIGS. 1 to 4.

The antenna apparatus 10 comprises a concave curved surface 12*a* (see FIG. 3) to reflect a radio wave, a rear surface 12*b* positioned on a back side of the concave curved surface 12*a*, a radio axis 12*c* of a radio wave reflected by the concave curved surface 12*a*, and a reflector 12 including a focal position 12*d* of the concave curved surface 12*a*. In the present embodiment, the concave curved surface 12*a* is configured by a parabolic shape, and a center of the rear surface 12*b* of the reflector 12 is supported by a publicly known supporting base 13. The supporting base 13 can be configured to support the reflector 12 so that the radio axis 12*c* is oriented and fixed in a predetermined direction, can be configured to support the reflector 12 so that the radio axis 12*c* is oriented in a desired direction within a predetermined range, or can be configured to support the reflector 12 so that the radio axis 12*c* is oriented in any desired direction.

In the supporting base 13, a publicly known radio wave transmitter-receiver (not shown) or one of a publicly known radio wave transmitter (not shown) and publicly known radio wave receiver (not shown) is housed, the radio wave transmitter-receiver (not shown) being for both of a radio wave to be transmitted from the reflector 12 and a radio wave to be received by the reflector 12, the radio wave transmitter (not shown) being only for a radio wave to be transmitted from the reflector 12, and the publicly known radio wave receiver (not shown) being only for a radio wave to be received by the reflector 12.

The antenna apparatus 10 further includes a radiator 14 arranged at the focal position 12*d* of the concave curved surface 12*a* of the reflector 12 and a structural unit 16 configured to support the radiator 14 at the focal position 12*d*. The radiator 14 is configured to perform at least one of transmission of two linearly polarized radio waves crossed to be orthogonal to each other toward the concave curved surface 12*a* of the reflector 12 and reception of the two linearly polarized radio waves from the concave curved surface 12*a*.

Figure 2:
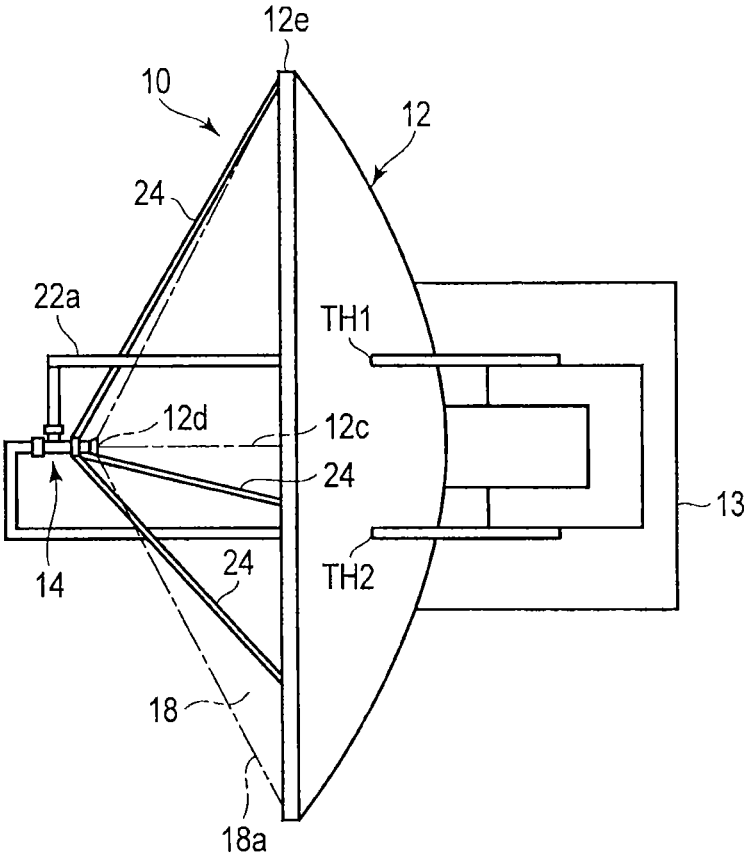
FIG. 2 is an exemplary plan view schematically showing the whole of the antenna apparatus shown in FIG. 1.

A radiation space 18 is defined between the concave curved surface 12*a* of the reflector 12 and the radiator 14, and a boundary of the radiation space 18 is designated by reference numeral 18*a* in FIGS. 1 and 2. In this embodiment, the concave curved surface 12*a* of the reflector 12 is formed of a parabolic shape, and thus the radiation space 18 has substantially a conical shape.

Two linear polarization planes 20*a*, 20*b* (see FIG. 3) are defined by two linearly polarized waves on the concave curved surface 12*a*. In this embodiment, one linearly polarized wave is a vertical linearly polarized wave, and thus the one linear polarization plane 20*a* is the vertical linear polarization plane. The other linearly polarized wave is a horizontal linearly polarized wave, and thus the other linear polarization plane 20*b* is the horizontal linear polarization plane.

The structural unit 16 includes a main body protruding from the rear surface 12*b* of the reflector 12 into the radiation space 18 at a position on the concave curved surface 12*a*, the position being apart from the two linear polarization planes 20*a*, 20*b*. In this embodiment, the main body of the structural unit 16 includes a first waveguide 22*a* for one linearly polarized wave and a second waveguide 22*b* for the other linearly polarized wave.

Specifically, in this embodiment, the first waveguide 22*a* and the second waveguide 22*b* extend upward from the publicly known radio wave transmitter-receiver (not shown) or one of the publicly known radio wave transmitter (not shown) and publicly known radio wave receiver (not shown), housed in the supporting base 13, in the back side of the reflector 12. Next, the first waveguide 22*a* and the second waveguide 22*b* pass through two through holes TH1, TH2 formed at positions in the concave curved surface 12*a* of the reflector 12, from the rear surface 12*b*, each of these positions being equidistant from the two linear polarization planes 20*a*, 20*b* (that is, each of these positions being 45° apart from the two linear polarization planes 20*a*, 20*b* by 45° around the radio axis 12*c*). And, then the first waveguide 22*a* and the second waveguide 22*b* extend along the radio axis 12*c* and in parallel with the radio axis 12*c* respectively, in the radiation space 18 up to a position of an outer side (front side) of the radiation space 18, the position being near the radiator 14. Further, respective extending ends of the first waveguide 22*a* and second waveguide 22*b* are connected to the radiator 14 in the outer side (front side) of the radiation space 18, in such a way that linearly polarized waves transmitted through respective waveguides are not degraded.

Figure 3:
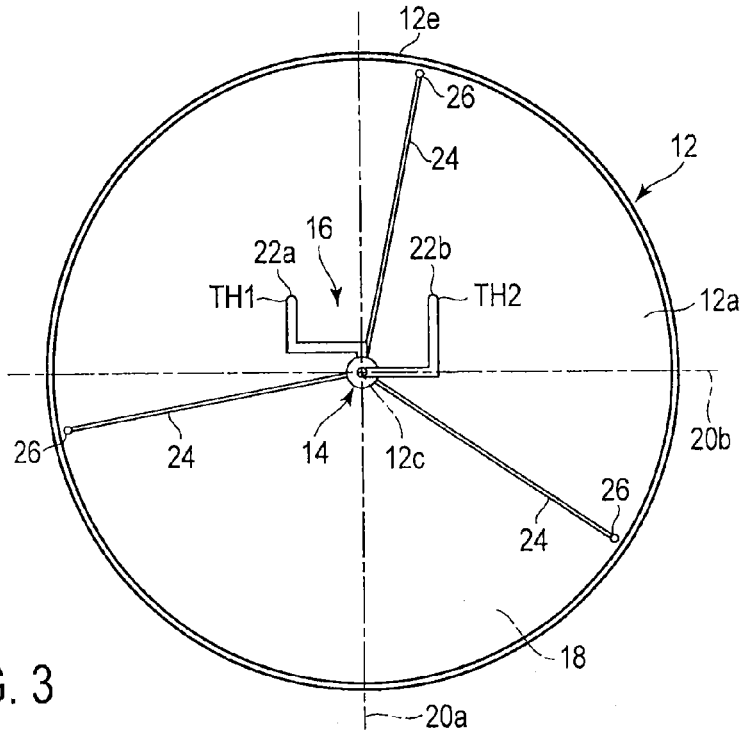
FIG. 3 is an exemplary schematic front view of a structural unit supporting a reflector and radiator of the antenna apparatus shown in FIG. 1.
Figure 4:
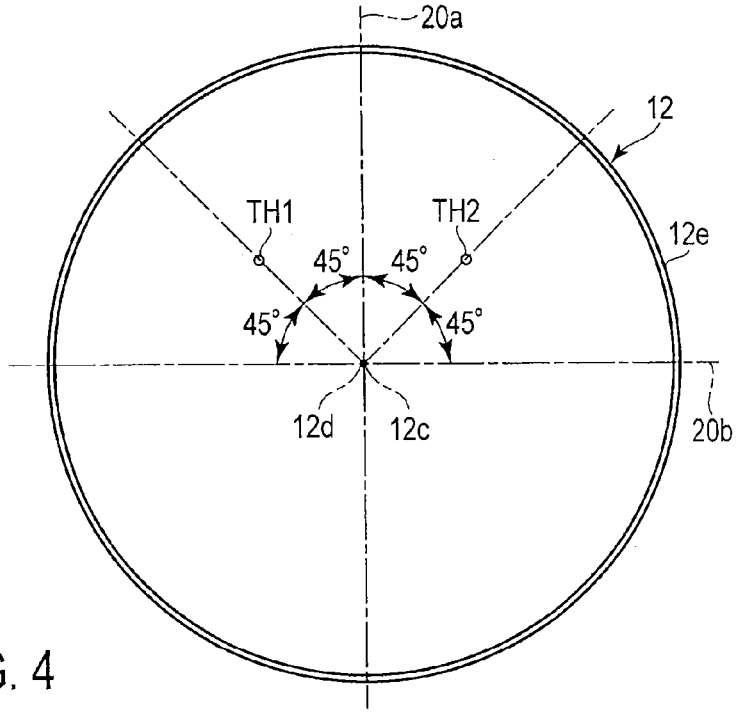
FIG. 4 is an exemplary schematic front view of the reflector of the antenna apparatus shown in FIG. 1, wherein positional arrangements of first and second waveguides as an example of a main body of the structural unit on a concave curved surface of the reflector from two linear polarization planes around a radio axis of the reflector are schematically shown.

More specifically, in this embodiment, the two through holes TH1, TH2 formed in the reflector 12 for the first and second waveguides 22*a* and 22*b* are formed, as shown most clearly in FIGS. 3 and 4, at two positions. One position is equidistant from the left half of the horizontal linear polarization plane 20*b* and the upper half of the vertical linear polarization plane 20*a*, and another position is equidistant from the right half of the horizontal linear polarization plane 20*b* and the upper half of the vertical linear polarization plane 20*a*, when the reflector 12 is viewed from a forward direction, that is, from the front. Further, the two through holes TH1, TH2 are arranged symmetrically with respect to the upper half of the vertical linear polarization plane 20*a* in the horizontal direction.

The extending end portion of the first waveguide 22*a* is connected to a predetermined position of the radiator 14 by combining a vertical extending part and a horizontal extending part. And, more concretely, the extending end portion of the first waveguide 22*a* extends vertically downward toward the left half of the horizontal linear polarization plane 20*b* in the outer side (front side) of the radiation space 18, and then extends horizontally to the right toward the radiator 14 along the left half of the horizontal linear polarization plane 20*b* in the outer side (front side) of the radiation space 18, and is finally connected to the predetermined position of the radiator 14 in the outer side (front side) of the radiation space 18.

The extending end portion of the second waveguide 22*b* is also connected to another predetermined position of the radiator 14 by combining a vertical extending part and a horizontal extending part. And, more concretely, the extending end portion of the second waveguide 22*b* extends toward the right half of the horizontal linear polarization plane 20*b* vertically downward in the outer side (front side) of the radiation space 18, and then extends to the left in the horizontal direction along the right half of the horizontal linear polarization plane 20*b* toward the radiator 14 in the outer side (front side) of the radiation space 18, and is finally connected to the predetermined position of the radiator 14 in the outer side (front side) of the radiation space 18.

In this embodiment, the structural unit 16 further includes a support member arranged in a position being outside of the radiation space 18 on the concave curved surface 12*a* of the reflector 12. As shown in FIGS. 1, 2 and 3, more specifically, the support member includes a plurality of stays 24 extending from a plurality positions arranged equidistantly along a ring-shaped outer frame 12*e* of the reflector 12 toward the radiator 14 in the outer side of the boundary 18*a* of the radiation space 18. Base end portions (that is, positioned in the outer frame side of the reflector 12) of the plurality of stays 24 are connected to the outer frame 12*e* of the reflector 12 with a publicly known connecting tool 26, and tip portions (that is, positioned near the radiator 14) of the plurality of stays 24 are connected to the radiator 14 in the outer side of the boundary 18*a* of the radiation space 18. To reduce influence on the two linearly polarized waves related to the reflector 12 to a minimum, it is preferable to arrange the support member (in this embodiment, the plurality of stays 24) at a position being apart from the two linear polarization planes (in this embodiment, the vertical linear polarization plane 20*a* and the horizontal linear polarization plane 20*b*) related to the two linearly polarized waves.

In this embodiment, the first and second waveguides 22*a*, 22*b* included in the main body of the structural unit 16, and the plurality of stays 24 included in the support member further included in the structural unit 16, support the radiator 14 at the focal position 12*d* of the concave curved surface 12*a* of the reflector 12.

[Result of Performance Evaluation Test]

Figure 5:
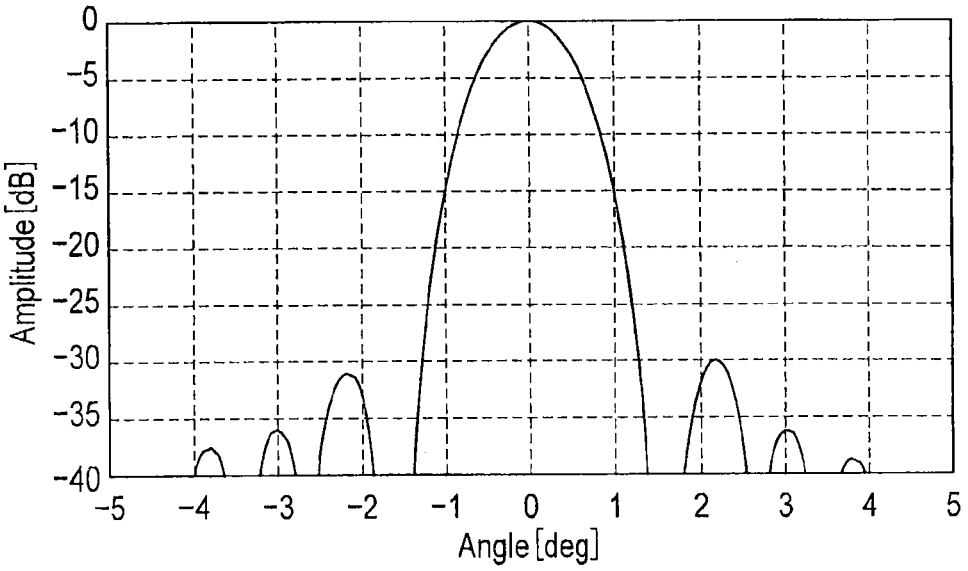
FIG. 5 is an exemplary diagram showing a radiation pattern of a vertical linearly polarized wave when the first and second waveguides as the example of the main body of the structural unit are arranged on a line passing the radio axis of the reflector and being orthogonal to a vertical linear polarization plane to be symmetrical with each other in right and left sides of the vertical linear polarization plane in the antenna apparatus shown in FIG. 1.
Figure 6:
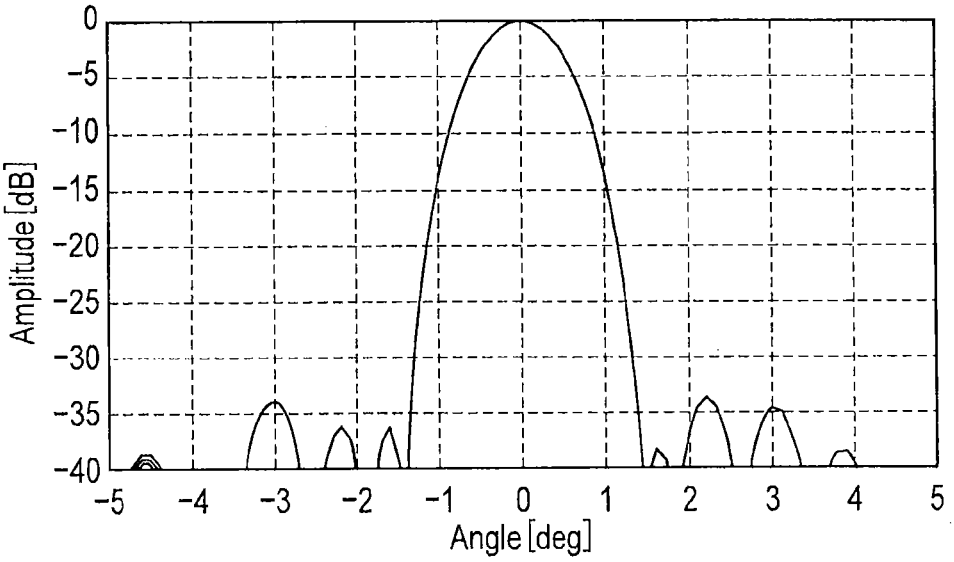
FIG. 6 is an exemplary diagram showing a radiation pattern of the vertical linearly polarized wave, wherein the first and second waveguides as the example of the main body of the structural unit are arranged at positions separating from an upper half of the vertical linear polarization plane toward a left half and right half of the horizontal linear polarization plane around the radio axis of the reflector on the concave curved surface of the reflector by 45° and being symmetrical to the upper half of the vertical linear polarization plane in the antenna apparatus shown in FIG. 1.
Figure 7:
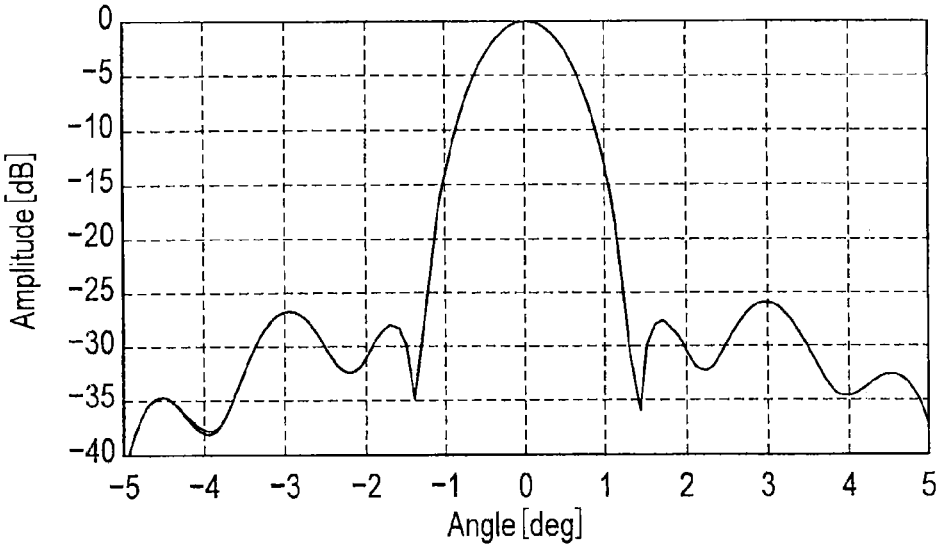
FIG. 7 is an exemplary diagram showing a radiation pattern of the vertical linearly polarized wave, wherein the first and second waveguides as the example of the main body of the structural unit are arranged on upper and lower sides of the vertical linear polarization plane passing the radio axis of the reflector to be symmetrical to the radio axis of the reflector on the concave curved surface of the reflector in the antenna apparatus in FIG. 1.

Next, radiation patterns of a vertical linearly polarized wave when the first waveguide 22*a* and the second waveguide 22*b* of the main body of the structural unit 16 are arranged at three kinds of positions relative to the vertical linear polarization plane 20*a* on the concave curved surface 12*a* of the reflector 12 will be compared with each other with reference to FIGS. 5, 6, and 7.

FIG. 5 is an exemplary diagram showing a radiation pattern of a vertical linearly polarized wave when the first and second waveguides 22*a* and 22*b* as the example of the main body of the structural unit 16 are arranged on a line passing the radio axis 12*c* of the reflector 12 and being orthogonal to the vertical linear polarization plane 20*a* to be symmetrical with each other in right and left sides of the vertical linear polarization plane 20*a* in the antenna apparatus 10 shown in FIG. 1.

In this case, there is no substantial turbulence in the radiation pattern and it is therefore clear that there is no substantial performance degradation of the antenna apparatus 10 in the vertical linearly polarized wave.

FIG. 6 is an exemplary diagram showing a radiation pattern of the vertical linearly polarized wave, wherein the first and second waveguides 22*a* and 22*b* as the example of the main body of the structural unit 16 are arranged at positions separating from the upper half of the vertical linear polarization plane 20*a* toward a left half and right half of the horizontal linear polarization plane 20*b* around the radio axis 12*c* of the reflector 12 on the concave curved surface 12*c* of the reflector 12 by 45° and being symmetrical to the upper half of the vertical linear polarization plane 20*a* in the antenna apparatus 10 shown in FIG. 1.

In this case, though slight turbulence is caused in the radiation pattern, it is clear that performance degradation of the antenna apparatus 10 in the vertical linearly polarized wave is small and no practical problem is caused.

FIG. 7 is an exemplary diagram showing a radiation pattern of the vertical linearly polarized wave, wherein the first and second waveguides 22*a* and 22*b* as the example of the main body of the structural unit 16 are arranged on upper and lower sides of the vertical linear polarization plane 20*a* passing the radio axis 12*c* of the reflector 12 to be symmetrical to the radio axis 12*c* of the reflector 12 on the concave curved surface 12*a* of the reflector 12 in the antenna apparatus 10 in FIG. 1.

In this case, high turbulence is caused in the radiation pattern, and it is clear that performance degradation of the antenna apparatus 10 related to the vertical linearly polarized wave is large and a practical problem is caused.

Similar things occur in:

i) a radiation pattern of a horizontal linearly polarized wave when the first and second waveguides 22*a* and 22*b* as the example of the main body of the structural unit 16 are arranged on a line passing the radio axis 12*c* of the reflector 12 and being orthogonal to the horizontal linear polarization plane 20*b* to be symmetrical with each other in upper and lower sides of the horizontal linear polarization plane 20*b* in the antenna apparatus 10 shown in FIG. 1;

ii) like the antenna apparatus 10 in FIG. 1, a radiation pattern of the horizontal linearly polarized wave, wherein the first and second waveguides 22*a* and 22*b* as the example of the main body of the structural unit 16 are arranged at positions separating from the upper half of the vertical linear polarization plane 20*a* toward the left half and right half of the horizontal linear polarization plane 20*b* around the radio axis 12*c* of the reflector 12 on the concave curved surface 12*c* of the reflector 12 by 45° and being symmetrical to the upper half of the vertical linear polarization plane 20*a* in the antenna apparatus 10 shown in FIG. 1; and iii) a radiation pattern of the horizontal linearly polarized wave, wherein the first and second waveguides 22*a* and 22*b* as the example of the main body of the structural unit 16 are arranged on right and left sides of the horizontal linear polarization plane 20*b* passing the radio axis 12*c* of the reflector 12 to be symmetrical to the radio axis 12*c* of the reflector 12 on the concave curved surface 12*a* of the reflector 12 in the antenna apparatus 10 in FIG. 1.

That is, in the case of i) described above, there is no substantial turbulence in the radiation pattern and it is therefore clear that there is no substantial performance degradation of the antenna apparatus 10 in the horizontal linearly polarized wave.

In the case of ii) described above, though slight turbulence is caused in the radiation pattern, it is clear that performance degradation of the antenna apparatus 10 in the horizontal linearly polarized wave is small and no practical problem is caused.

In the case of iii) described above, high turbulence is caused in the radiation pattern and it is clear that performance degradation of the antenna apparatus 10 in the horizontal linearly polarized wave is large and a practical problem is caused.

From these results, in an antenna apparatus comprising a reflector including a concave curved surface, and a radiator, and using two linearly polarized waves crossed to be orthogonal to each other like a vertical linearly polarized wave and horizontal linearly polarized wave, if a main body of a structural unit configured to support a radiator at a focal position of the reflector and protruding from a rear surface of the reflector into a radiation space on the concave curved surface of the reflector is positioned apart from the two linear polarization planes, it is clear that, though slightly turbulence is caused in respective radiation patterns of the vertical linearly polarized wave and the horizontal linearly polarized wave, performance degradation of the antenna apparatus in each of the vertical linearly polarized wave and horizontal linearly polarized wave is small and no practical problem is caused.

In the antenna apparatus 10 according to the first embodiment shown in FIGS. 1 to 4, each of the first and second waveguides 22*a*, 22*b* included in the main body of the structural unit 16 configured to support the radiator 14 in the focal position 12*d*, the main body protruding from the rear surface 12*b* of the reflector 12 into the radiation space 18 through the concave curved surface 12*a* of the reflector 12, is arranged at a position equidistantly apart from the vertical linear polarization plane 20*a* and the horizontal linear polarization plane 20*b* as the example of two linear polarization planes, that is, at a position being apart from each of the vertical linear polarization plane 20*a* and horizontal linear polarization plane 20*b* by 45° around the radio axis 12*c*.

Figure 8:
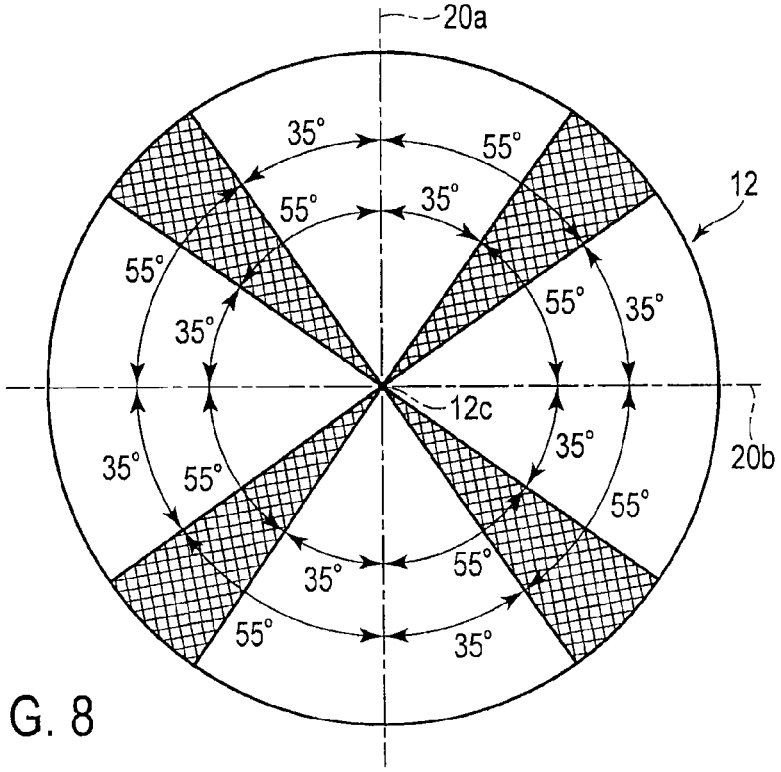
FIG. 8 is an exemplary schematic front view of a reflector, wherein a range, in which a main body of a structural unit can be arranged on a concave curved surface of the reflector of an antenna apparatus, in each of the above described embodiments, is shown, the range being separated from two linear polarization planes crossed to each other around a radio axis of the reflector.

However, experimental results by the inventor of the present application show that, as shown in FIG. 8, if each of the first and second waveguides 22*a*, 22*b* included in the main body of the structural unit 16 protruding from the rear surface 12*b* of the reflector 12 into the radiation space 18 on the concave curved surface 12*a* of the reflector 12 is arranged in a range (meshed in FIG. 8) between a position of 35° and a position of 55°, each of which is apart from the vertical linear polarization plane 20*a* and from the horizontal linear polarization plane 20*b* as the example of two linear polarization planes (meshed in FIG. 8), small turbulence of the radiation pattern of each of the vertical linearly polarized wave and horizontal linearly polarized wave and small performance degradation of the antenna apparatus in each of the vertical linearly polarized wave and horizontal linearly polarized wave cause no practical problem.

Second Embodiment

Figure 9:
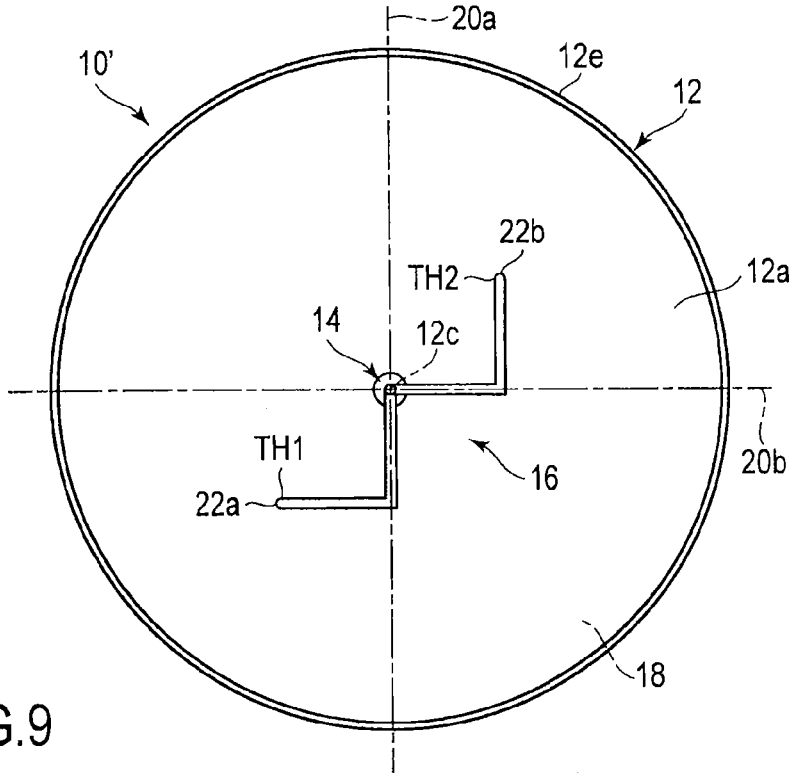
FIG. 9 is an exemplary schematic front view of a structural unit supporting a reflector and radiator of an antenna apparatus according to a second embodiment.

Next, a configuration of an antenna apparatus 10' according to a second embodiment will be described with reference to FIG. 9.

Since most of the configuration of the antenna apparatus 10' according to the second embodiment is the same as most of the configuration of the antenna apparatus 10 according to the first embodiment described above with reference to FIGS. 1 to 4, the illustration and description of the same constituting members are omitted. And, in the antenna apparatus 10' according to the second embodiment shown in FIG. 9, the same reference numerals as those designated the constituting members in the antenna apparatus 10 according to the first embodiment and corresponding to the same constituting members in the antenna apparatus 10' according to the second embodiment shown in FIG. 9 are designated the same constituting members in the antenna apparatus 10' according to the second embodiment shown in FIG. 9, and detailed descriptions thereof are omitted.

The configuration of the antenna apparatus 10' is different from that of the antenna apparatus 10 according to the first embodiment in the position of the one through hole TH1 formed through the concave curved surface 12*a* of the reflector 12, for the first waveguide 22*a* configuring a part of the main body of the structural unit 16. In this embodiment, the through hole TH1 is formed at a position equidistant from the left half of the horizontal linear polarization plane 20*b* and the lower half of the vertical linear polarization plane 20*a* (that is, a position of 45° around the radio axis 12*c*) when the reflector 12 is viewed from the forward direction, that is, from the front. Further, the two through holes TH1 and TH2 are arranged symmetrically with respect to the radio axis 12*c* of the reflector 12.

The first waveguide 22*a* passing through the concave curved surface 12*a* from the rear surface 12*b* of the reflector 12 at the through hole TH1 extends along the radio axis 12*c* and in parallel with the radio axis 12*c* up to a position being located in the outer side (front side) of the radiation space 18 and being near the radiator 14. Further, the extending end portion of the first waveguide 22*a* is connected to the radiator 14 in the outer side (front side) of the radiation space 18 in such a way that the linearly polarized wave transmitted through the extending end portion of the waveguide is not degraded.

The extending end portion of the first waveguide 22*a* is connected to a predetermined position of the radiator 14 by combining a vertical extending part and a horizontal extending part. And, more concretely, the extending end portion of the first waveguide 22*a* extends horizontally to the right along the left half of the horizontal linear polarization plane 20*b* in the outer side (front side) of the radiation space 18, and then extends vertically upward toward the radiator 14 in the outer side (front side) of the radiation space 18, and finally is connected to the predetermined position of the radiator 14 in the outer side (front side) of the radiation space 18.

The antenna apparatus 10' according to the second embodiment as described above achieves antenna performance equivalent to that of the antenna apparatus 10 according to the first embodiment described above with reference to FIGS. 1 to 4.

Also in the present embodiment, like being shown in FIG. 8, even if the through hole TH1 is formed in a range between a position of 35° and a position of 55° from the left half of the horizontal linear polarization plane 20*b* and the lower half of the vertical linear polarization plane 20*a* around the radio axis 12*c* when the reflector 12 is viewed from the forward direction, that is, from the front, antenna performance without practical problem can be achieved.

Third Embodiment

Next, a configuration of an antenna apparatus 10" according to a third embodiment will be described with reference to FIG. 10.

Since most of the configuration of the antenna apparatus 10" according to the third embodiment is the same as most of the configuration of the antenna apparatus 10 according to the first embodiment described above with reference to FIGS. 1 to 4, the illustration and description of the same constituting members are omitted. And, in the antenna apparatus 10" according to the third embodiment shown in FIG. 10, the same reference numerals as those designated the constituting members in the antenna apparatus 10 according to the first embodiment and corresponding to the same constituting members in the antenna apparatus 10" according to the third embodiment shown in FIG. 10 are designated the same constituting members in the antenna apparatus 10" according to the third embodiment shown in FIG. 10, and detailed descriptions thereof are omitted.

The configuration of the antenna apparatus 10" is different from that of the antenna apparatus 10 according to the first embodiment in the positions of the two through holes TH1 and TH2 formed through the concave curved surface 12*a* of the reflector 12, for the first and second waveguides 22*a* and 22*b* configuring the main body of the structural unit 16.

Figure 10:
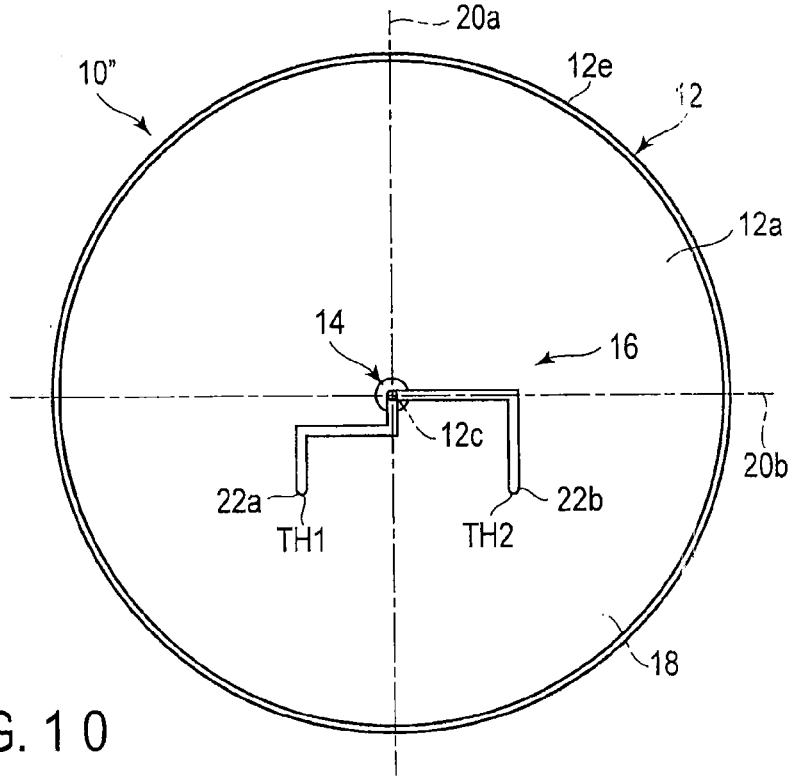
FIG. 10 is an exemplary schematic front view of a structural unit supporting a reflector and radiator of an antenna apparatus according to a third embodiment.

Specifically, in this embodiment, the two through holes TH1 and TH2 formed in the reflector 12 for the first waveguide 22*a* and the second waveguide 22*b* are formed, as shown in FIG. 10, at a position equidistant from the left half of the horizontal linear polarization plane 20*b* and the lower half of the vertical linear polarization plane 20*a* (a position of 45° around the radio axis 12*c*) and at a position equidistant from the right half of the horizontal linear polarization plane 20*b* and the lower half of the vertical linear polarization plane 20*a* (a position of 45° around the radio axis 12*c*) when the reflector 12 is viewed from the forward direction, that is, from the front. Further, the two through holes TH1 and TH2 are arranged symmetrically with respect to the lower half of the vertical linear polarization plane 20*a* in the horizontal direction.

Each of the first and second waveguides 22*a* and 22*b* passing through the reflector 12 from the rear surface 12*b* to the concave curved surface 12*a* at the through holes TH1 and TH2 extends along the radio axis 12*c* and in parallel with the radio axis 12*c* up to a position of the outer side (front side) of the radiation space 18, the position being near the radiator 14. Further, the extending end portion of each of the first waveguide 22*a* and the second waveguide 22*b* is connected to the radiator 14 in the outer side (front side) of the radiation space 18 in such a way that linearly polarized waves transmitted through the extending end portions of the waveguides are not degraded.

More specifically, the extending end portion of the first waveguide 22*a* is connected to a predetermined position of the radiator 14 by combining a vertical extending portion and a horizontal extending portion. And, more concretely, the extending end portion of the first waveguide 22*a* extends vertically upward toward the left half of the horizontal linear polarization plane 20*b* in the outer side (front side) of the radiation space 18, and then extends horizontally to the right toward the radiator 14 along the left half of the horizontal linear polarization plane 20*b* in the outer side (front side) of the radiation space 18, and is finally connected to the predetermined position of the radiator 14 in the outer side (front side) of the radiation space 18.

The extending end portion of the second waveguide 22*b* is also connected to a predetermined position of the radiator 14 by combining a vertical extending portion and a horizontal extending portion. And, more concretely, the extending end portion of the second waveguide 22*b* extends vertically upward toward the right half of the horizontal linear polarization plane 20*b* in the outer side (front side) of the radiation space 18, and then extends horizontally to the left toward the radiator 14 along the right half of the horizontal linear polarization plane 20*b* in the outer side (front side) of the radiation space 18, and is finally connected to the predetermined position of the radiator 14 in the outer side (front side) of the radiation space 18.

The antenna apparatus 10" according to the third embodiment as described above with reference to FIG. 10 achieves antenna performance equivalent to that of the antenna apparatus 10 according to the first embodiment described above with reference to FIGS. 1 to 4.

Also, in this embodiment, like being shown in FIG. 8, even if the through hole TH1 is formed in a range between a position of 35° and a position of 55° from the left half of the horizontal linear polarization plane 20*b* and the lower half of the vertical linear polarization plane 20*a* around the radio axis 12*c* when the reflector 12 is viewed from the forward direction, that is, from the front, antenna performance without practical problem can be achieved. Further, even if the through hole TH2 is formed in a range between a position of 35° and a position of 55° from the right half of the horizontal linear polarization plane 20*b* and the lower half of the vertical linear polarization plane 20*a* around the radio axis 12*c* when the reflector 12 is viewed from the forward direction, that is, from the front, antenna performance without practical problem can be achieved.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna apparatus comprising:

a reflector including a concave curved surface for reflecting a radio wave, a rear surface positioned on a back side of the concave curved surface, a radio axis of the radio wave reflected by the concave curved surface, and a focal position of the concave curve;

a radiator arranged in the focal position of the concave curved surface of the reflector and configured to perform at least one of transmission of the radio wave of two linearly polarized waves toward the concave curved surface of the reflector and reception of the radio wave from the concave curved surface, the two linearly polarized waves being crossed orthogonally to each other; and a structural unit configured to support the radiator at the focal position, wherein a radiation space is defined between the concave curved surface of the reflector and the radiator, two linear polarization planes are defined by two linearly polarized waves on the concave curved surface, and the structural unit includes a main body provided with first and second waveguides protruding from the rear surface of the reflector into the radiation space at two positions on the concave curved surface of the reflector, the two positions being apart from the two linear polarization planes in both sides of one of the two linear polarization planes and being symmetric with each other, and the first and second waveguides extending along the radio axis to be in parallel to the radio axis to an outside of the radiation space and having extending end portions connected to the radiator.

2. The antenna apparatus according to claim 1, wherein each of the first and second waveguides of the main body of the structural unit is arranged in a range between 35° and 55° around the radio axis from the two linear polarization planes in the radiation space of the reflector.

3. The antenna apparatus according to claim 2, wherein each of the first and second waveguides of the main body of the structural unit is arranged at a position of 45° around the radio axis from the two linear polarization planes in the radiation space of the reflector.

4. The antenna apparatus according to claim 1, wherein the structural unit includes a support member which is arranged in a position being outside of the radiation space on the concave curved surface of the reflector and being shifted from the two linear polarization planes.

5. The antenna apparatus according to claim 1, wherein the two linearly polarized waves are a vertical linearly polarized wave and a horizontal linearly polarized wave, the one of the two linear polarization planes is a vertical linear polarization plane defined by the vertical linearly polarized wave, and the two positions are arranged in one of an upper side and a lower side of a horizontal linear polarization plane defined by the horizontal linearly polarized wave.

6. The antenna apparatus according to claim 5, wherein the extending end portion of each of the first and second waveguides is connected to a predetermined position of the radiator by combining a vertical extending part and a horizontal extending part.

7. The antenna apparatus according to claim 1, wherein the two linearly polarized waves are a vertical linearly polarized wave and a horizontal linearly polarized wave, the one of the two linear polarization planes is a horizontal linear polarization plane defined by the horizontal linearly polarized wave, one of the two positions is arranged in an upper side of a horizontal linear polarization plane defined by the horizontal linearly polarized wave, and the other of the two positions is arranged in a lower side of the horizontal linear polarization plane.

8. The antenna apparatus according to claim 7, wherein the extending end portion of each of the first and second waveguides is connected to a predetermined position of the radiator by combining a vertical extending part and a horizontal extending part.

* * * * *